US007579563B2

(12) United States Patent
Inagaki et al.

(10) Patent No.: US 7,579,563 B2
(45) Date of Patent: Aug. 25, 2009

(54) TRIGGER SWITCH

(75) Inventors: Isao Inagaki, Kanagawa (JP); Satoru Kowaki, Kanagawa (JP)

(73) Assignee: Satori S-Tech Co., Ltd., Tokyo (JP)

( * ) Notice: Subject to any disclaimer, the term of this patent is extended or adjusted under 35 U.S.C. 154(b) by 0 days.

(21) Appl. No.: 12/222,160

(22) Filed: Aug. 4, 2008

(65) Prior Publication Data

US 2009/0032377 A1 Feb. 5, 2009

(30) Foreign Application Priority Data

Aug. 3, 2007 (JP) ..... 2007-202733

(51) Int. Cl.
*H01H 9/20* (2006.01)

(52) U.S. Cl. ..... 200/43.17; 200/522; 200/332.2

(58) Field of Classification Search ..... 200/43.01, 200/43.11, 43.13, 43.16, 43.17, 43.18, 522, 200/318, 318.1, 321, 322, 332.2
See application file for complete search history.

(56) References Cited

U.S. PATENT DOCUMENTS 3,329,789 A * 7/1967 Sahrbacker ..... 200/522
3,536,973 A * 10/1970 Matthews et al. ..... 388/830
3,829,645 A * 8/1974 Piber ..... 200/43.17
3,872,274 A * 3/1975 Piber ..... 200/43.17
4,002,874 A * 1/1977 Brown ..... 200/321
RE30,270 E * 5/1980 Piber ..... 200/43.17
4,271,342 A * 6/1981 Sistare ..... 200/332.2
4,296,290 A * 10/1981 Peot ..... 200/325
4,549,097 A * 10/1985 Ulmer ..... 307/326
5,012,057 A * 4/1991 Inuyama ..... 200/522
6,555,773 B1 * 4/2003 Broghammer et al. ... 200/61.85
6,653,584 B1 * 11/2003 Chen ..... 200/332.2
6,812,425 B1 * 11/2004 Wong ..... 200/522
6,958,455 B1 * 10/2005 Lui ..... 200/43.17
6,989,503 B2 * 1/2006 Wong ..... 200/522

FOREIGN PATENT DOCUMENTS

JP 2003-109451 4/2003

* cited by examiner

*Primary Examiner*—Michael A Friedhofer
(74) *Attorney, Agent, or Firm*—Wenderoth, Lind & Ponack, LLP.

(57) ABSTRACT

Disclosed a trigger switch having a trigger to be locked stably when it is pulled in. The trigger has wall surfaces disposed oppositely leaving a space therebetween. Pivotal holes are formed in the wall surfaces and a pivotal shaft is inserted in said holes. Rotary shaft holes are formed in the wall surfaces, and a rotary shaft for inverting a switch is inserted in the rotary shaft holes. A stopper for stopping the trigger from being pulled while rotating about the pivotal shaft is mounted between the pivotal shaft and the rotary shaft. The stopper includes a stopper shaft engaged in stopper holes formed in the wall surfaces. A stopper button is mounted at an end of the stopper shaft. When the stopper button is pushed, the stopper shaft is moved to place a thinned portion thereof into the stopper holes, thus releasing the trigger from the stopper.

2 Claims, 6 Drawing Sheets

TRIGGER SWITCH

BACKGROUND OF THE INVENTION

1. Field of the Invention

The present invention relates to a trigger switch, and more particularly, to a trigger switch having a trigger structure equipped with a stopper being improved strength.

2. Prior Art

As shown in FIG. 5A, a conventional electric power tool is composed of a body portion 111 and a handle portion 112 connected to the body portion 111. An electric motor for producing rotating power and a deceleration mechanism for decelerating the rotating power are accommodated in the body portion 111. The tool is rotationally driven according to the degree to which the trigger is pulled. A tool such as a grinder or metal saw is mounted to the front end of the body portion.

A trigger switch 113 having the trigger that is designed to be pulled directly by hand fingers is accommodated in the handle portion 112. As shown in FIGS. 5 and 6, the trigger switch 113 includes a control portion 114 and a switch body 115. The control portion 114 has a trigger capable of being manipulated by gripping power of a hand. The switch body 115 incorporates a switch that is turned on and off according to the degree to which the trigger is pulled.

The control portion 114 includes the trigger 116 directly touched by hand fingers and a return spring 117 accommodated inside the trigger 116. The spring 117 acts to return the pulled trigger to its original state.

The trigger 116 is bifurcated and has a touch portion 118, a first wall surface 119, and a second wall surface 121. The touch portion 118 has a bifurcated, curved back portion and is directly touched by fingers. The first and second wall surfaces 119 and 121 are parallel and opposite to the bifurcated portions. The first and second wall surfaces 119 and 121 are provided with pivotal holes 124 near the touch portion 118. A trigger support portion 122 extends from the switch body 115. A pivotal shaft 123 is mounted at the front end of the trigger support portion 122 and engaged in the pivotal holes 124.

A switch transfer portion 125 for turning on and off the contacts of the switch accommodated in the switch body is provided with a rotary bearing portion 126 at the front end thereof. An axial hole 127 is formed at the rotary bearing portion 126, and a rotary axial hole 128 is formed at the end opposite to the pivotal holes 124 to permit a fixture element 145 to be inserted and engaged.

A stopper portion 129 is mounted between the pivotal holes 124 and the rotary axial hole 128 to prevent fingers from being pulled in if the fingers touch the touch portion 118 near the rotary axial hole 128.

The stopper portion 129 has a guide slot 133 formed along the diameter of rotation, a metal plate 130 mounted inside the first wall surface 119, a stopper shaft 131 made of a guide rod 138, and a stopper button 143 mounted to an end of the stopper shaft 131 via a spring 144. The guide slot 133 acts to guide the stopper shaft 131 when the trigger 116 is pulled into the first wall surface 119 and rotated. The metal plate 130 has a stopper hole 132 that is slightly smaller than the guide slot 133. The stopper hole 132 extends in the same direction as the guide slot 133 and acts also as a stopper. A stopper member 136 having a cylindrical end portion having an enlarged diameter is mounted in the guide slot 133. The guide rod 138 is adjacent to the stopper member 136 but has a reduced diameter. The guide rod 138 is so long that it reaches the other second wall surface 121.

The metal plate 130 is mounted with the fixture element 145 engaged in the rotary axial hole 128 and with the pivotal shaft 123 engaged in the pivotal holes 124. The metal plate 130 has a stopper hole 132*a* narrower than the stopper hole 132 and a guide slot 133*a* narrower than the guide slot 133.

In the trigger switch having the structure as described so far, if fingers are brought into contact with the touch portion 118 and the touch portion is pulled in, the stopper member 136 of the stopper shaft 131 comes into abutment with the stopper hole 132*a* in the metal plate 130 as shown in FIG. 7, thus hindering the trigger from being pulled in.

When the trigger is pulled in, the stopper button 143 is pushed. This pushes the stopper member 136 of the stopper shaft 131 outwardly as shown in FIG. 8. Consequently, the stopper member is disengaged from the stopper hole 132*a*. The trigger is pulled in along the guide slot 133*a* according to the degree to which the trigger is drawn in. When the trigger is pulled in by a given amount the switch mounted in the switch body is inverted and turned on (see JP-A-2003-109451).

However, the stopper member of one conventional trigger already described is so constructed that the stopper member of the stopper shaft is abutted against the guide slot formed in one wall surface to stop the trigger from being pulled in and, therefore, if the trigger is forcibly pulled in, the trigger and the stopper shaft itself become oblique. As a result, there arises the problem that the stopper member is forced into the guide slot, destroying it.

Furthermore, in the other conventional structure already described, a stopper hole is formed in a metal plate instead of the guide slot formed in one wall surface. Even in this structure, it is impossible to avoid the phenomenon that the trigger becomes oblique as it is pulled in. The pull-in operation is unstable. In addition, an additional metal plate is mounted. Hence, there is the problem that the additional metal plate complicates the structure and increases the number of components.

SUMMARY OF THE INVENTION

Accordingly, it is an object of the present invention to provide a trigger switch having a trigger equipped with a stopper assured that the trigger is locked stably when the trigger is pulled in, and the trigger itself has improved strength.

A trigger switch according to the present invention comprises a trigger having wall surfaces adjacent to each other on a base side, the wall surfaces being disposed opposite to each other with a given space therebetween; a touch portion adapted to be touched by fingers, the touch portion being located on the base side; pivotal holes formed in the wall surfaces and located above and closer to the touch portion; a pivotal shaft inserted in the pivotal holes such that the shaft is interposed between the pivotal holes; rotary shaft holes formed in the wall surfaces; a rotary shaft for inverting a switch, the rotary shaft being located at a position remote from the pivotal shaft and from the touch portion, the rotary shaft being inserted in the rotary shaft holes such that the rotary shaft is interposed between the rotary shaft holes; and a stopper for stopping the trigger from being pulled in while being rotated about the pivotal shaft, the stopper being mounted between the pivotal shaft and the rotary shaft; wherein the stopper including a first and second stopper holes formed in the wall surfaces, a stopper shaft engaged in the first and second stopper holes, and a stopper button mounted at an end of the stopper shaft; the first and second stopper holes having a first and second guide slots communicating with the stopper holes and being narrower than diameters of the first and second stopper holes; the stopper shaft having a first and second lock portions having smaller diameters than ones of the first and second stopper holes but larger than width of the first and second guide slots, and a first and second guide portions having smaller diameters than ones of the first and second guide slots to allow insertion of the guide portions therein; whereby when the stopper button is pushed, the stopper shaft is moved to remove the first and second lock portions from the first and second stopper holes, and the first and second guide slots are moved into the first and second guide slots, thus releasing the trigger from the stopper.

It is favorable that the stopper shaft is provided with a return spring incorporated to return the trigger to its original state.

The trigger switch associated with the present invention is equipped with stopper mechanisms on both wall surfaces constituting the trigger. Consequently, a stably operating lock mechanism can be accomplished without the need of a metal plate or the like.

DETAILED DESCRIPTION OF THE PREFERRED EMBODIMENTS

Embodiments of a trigger switch and an electric power tool according to the present invention are described with reference to the drawings.

Figure 1:
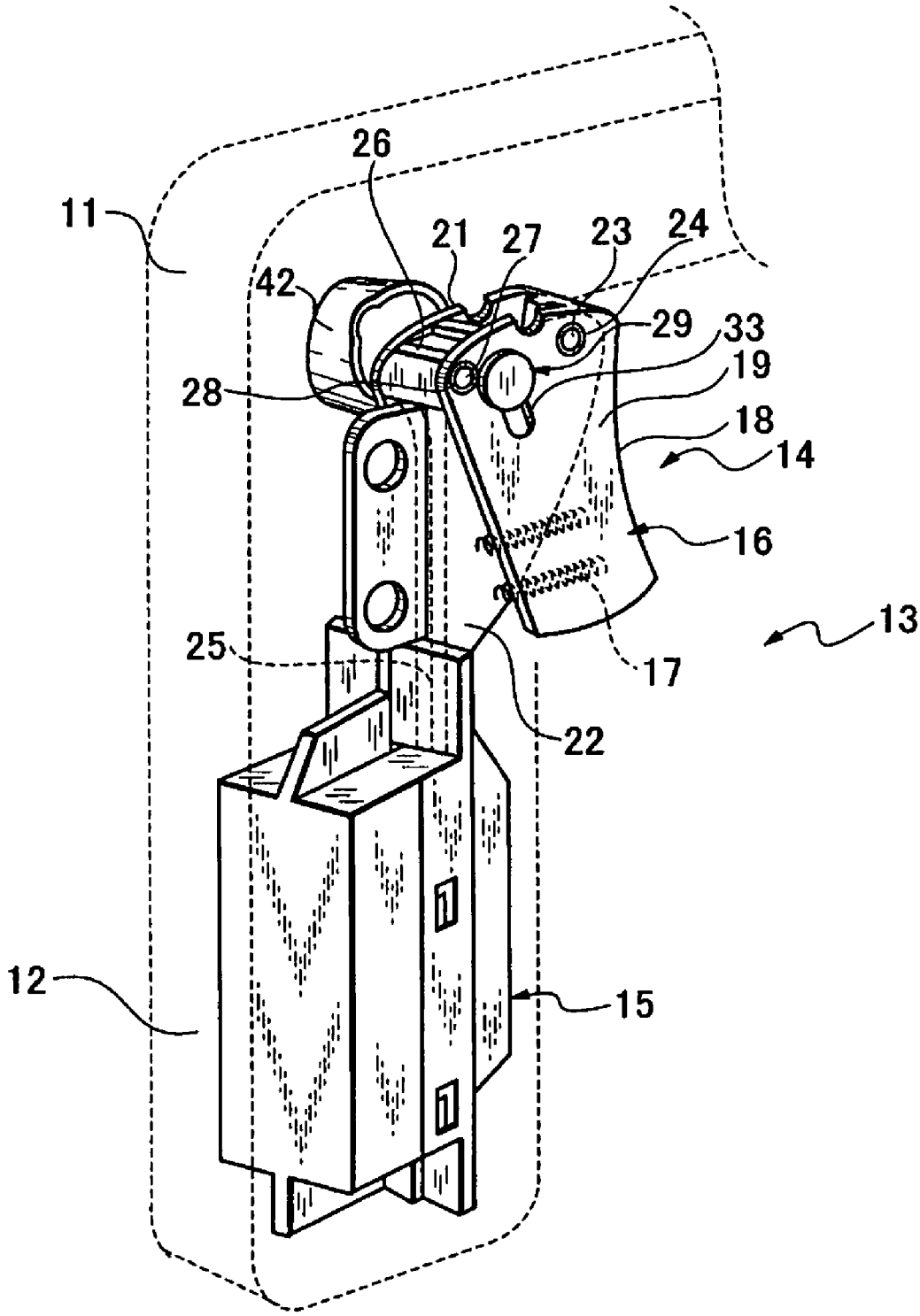
FIG. 1 is a perspective view of a trigger switch according to the present invention, the trigger switch being mounted to an electric power tool.

The electric power tool equipped with a trigger switch according to the present invention is composed of a body portion 11 and a handle portion 12 connected to the body portion 11, as shown in FIG. 1.

An electric motor for producing rotating power and a deceleration mechanism for decelerating the rotating power are incorporated in the body portion 11. The tool is rotationally driven according to the degree to which the trigger is pulled. The tool such as a grinder or metal saw is mounted to the front end of the body portion.

A trigger switch 13 having the trigger designed to be pulled in with hand fingers is accommodated in the handle portion 12. The trigger switch 13 includes a control portion 14 and a switch body 15. The control portion 14 has a trigger 16 capable of being manipulated by gripping power of a hand. The switch body 15 incorporates a switch that is turned on and off according to the degree to which the trigger is pulled. The control portion 14 includes the trigger 16 directly touched by hand fingers and a return spring 17 accommodated inside the trigger 16. The spring 17 acts to return the pulled trigger to its original state.

The trigger 16 is bifurcated and has a touch portion 18, a first wall surface 19, and a second wall surface 21. The touch portion 18 has a bifurcated, curved back portion and is directly touched by fingers. The touch portion 18 acts as a base portion. The first and second wall surfaces 19 and 21 are parallel and opposite to the bifurcated portions. The first and second wall surfaces 19 and 21 are provided with pivotal holes 24 formed in the wall surfaces at higher positions near the touch portion 18. A trigger support portion 22 extends from the switch body. A pivotal shaft 23 is mounted at the front end of the trigger support portion 22 and engaged in the pivotal holes 24.

A switch transfer portion 25 for turning on and off the contacts of a switch accommodated in the switch body is mounted. A rotary bearing portion 26 is mounted at the front end of the switch transfer portion 25. A rotary shaft hole 28 in which a rotary shaft 27 is engaged is formed at the end on the opposite side of the pivotal holes 24. The rotary bearing portion 26 is received by the rotary shaft 27. A stopper portion 29 is mounted between the pivotal holes 24 and the rotary shaft holes 28 to prevent fingers from being pulled in if the fingers touch the touch portion 18 near the rotary shaft hole 28.

The stopper portion 29 is provided with a first stopper hole 32 for locking the trigger 16 by the stopper shaft 31 when the trigger 16 is pulled into one, or first, wall surface 19 and rotated. A first guide slot 33 is formed in a radial direction in which the trigger 16 rotates, and is continuous with the first stopper hole 32. A second stopper hole 34 and a second guide slot 35 which are identical in position with the first stopper hole 32 and first guide slot 33 formed in one, or first wall surface 19 but narrower than the holes 32 and 33 are formed in the other second wall surface 21.

Figure 2:
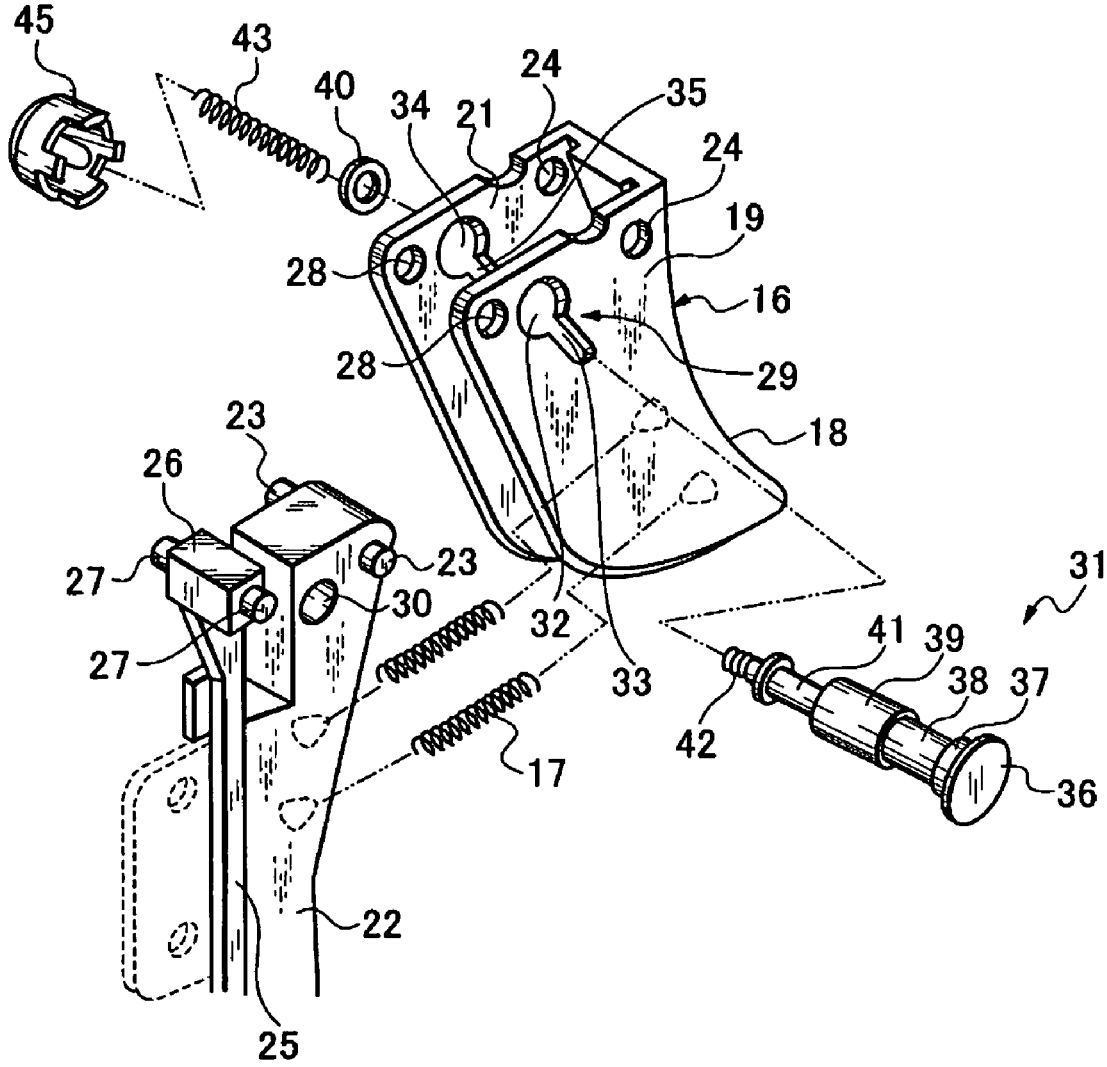
FIG. 2 is an exploded perspective view of the trigger portion of the trigger switch.

As shown in FIG. 2, the stopper shaft 31 is made of a shaft having a portion of an increased diameter and portions of reduced diameters such that the shaft is engaged in the first stopper hole 32 and second stopper hole 34 formed in the first wall surface 19 and second wall surface 21 on both sides to lock the shaft. The shaft includes a dish-like portion 36 at one end, a first lock portion 37 adjacent to the dish-like portion 36, a first guide portion 38 adjacent to the first lock portion 37, a second lock portion 39 adjacent to the first guide portion 38, a second guide portion 41 adjacent to the second lock portion 39, and a button engagement portion 42 adjacent to the second guide portion 41. The dish-like portion 36 is larger in diameter than the first stopper hole 32 and first guide slot 33 such that the dish-like portion 36 is engaged. The first lock portion 37 has a thickness at which the dish-like portion 36 is engaged in the first stopper hole 32. The first guide portion 38 has a thickness at which the first guide portion 38 can pass through the first guide slot 33. The second lock portion 39 has a thickness at which the second lock portion 39 is engaged in the second stopper hole 34. The second guide portion 41 has a thickness at which the second guide portion 41 can pass through the second guide slot 35. The stopper button 45 is pressed and engaged into the button engagement portion 42

The stopper shaft 31 is inserted from the side of the first stopper hole 32 and passed through an insertion hole 30 formed in the trigger support portion 22 and through the second stopper hole 34. Then, the shaft 31 is anchored to the stopper button 45 via a washer 40 and a spring 43.

Figure 3:
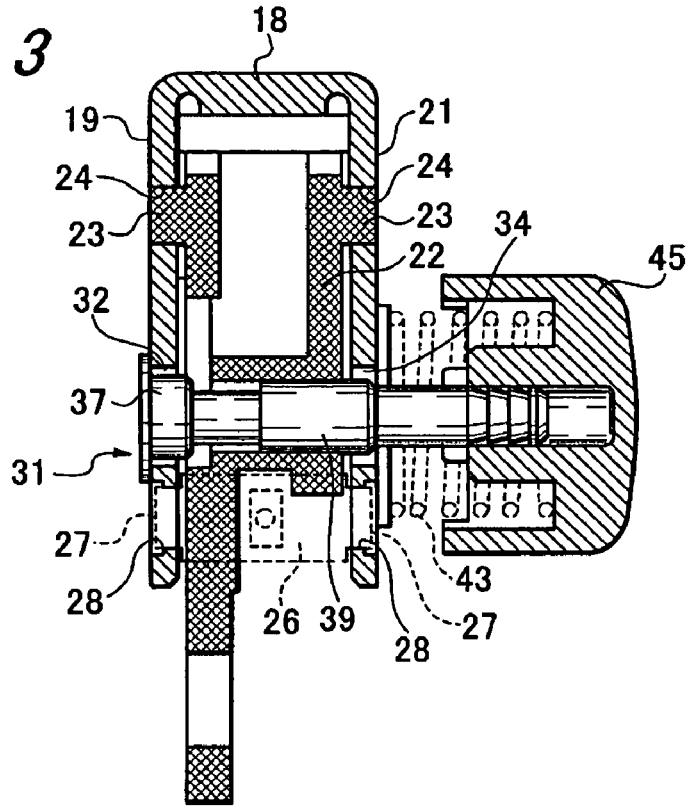
FIG. 3 is a vertical cross section of the trigger portion in which the stopper button is not pushed.

In the trigger switch constructed in this way, if fingers are applied to the touch portion 18 and it is pulled in as shown in FIG. 3, the first lock portion 37 and the second lock portion 39 of the stopper shaft 31 come into abutment with the first stopper hole 32 and the second stopper hole 34, respectively, thus stopping the trigger 16 from being pulled in.

Figure 4:
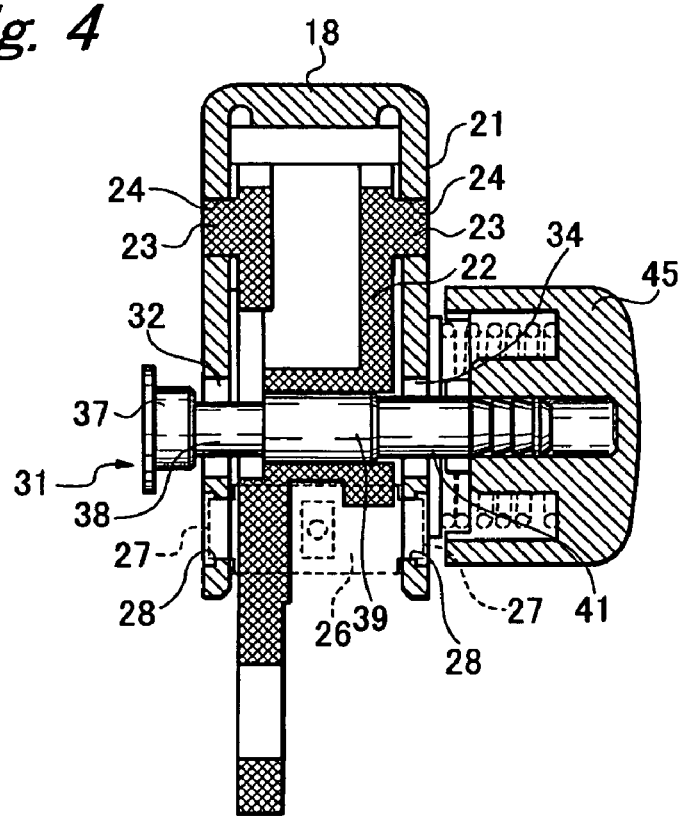
FIG. 4 is a vertical cross section of the trigger portion in which the stopper button has been pushed.
Figure 5:
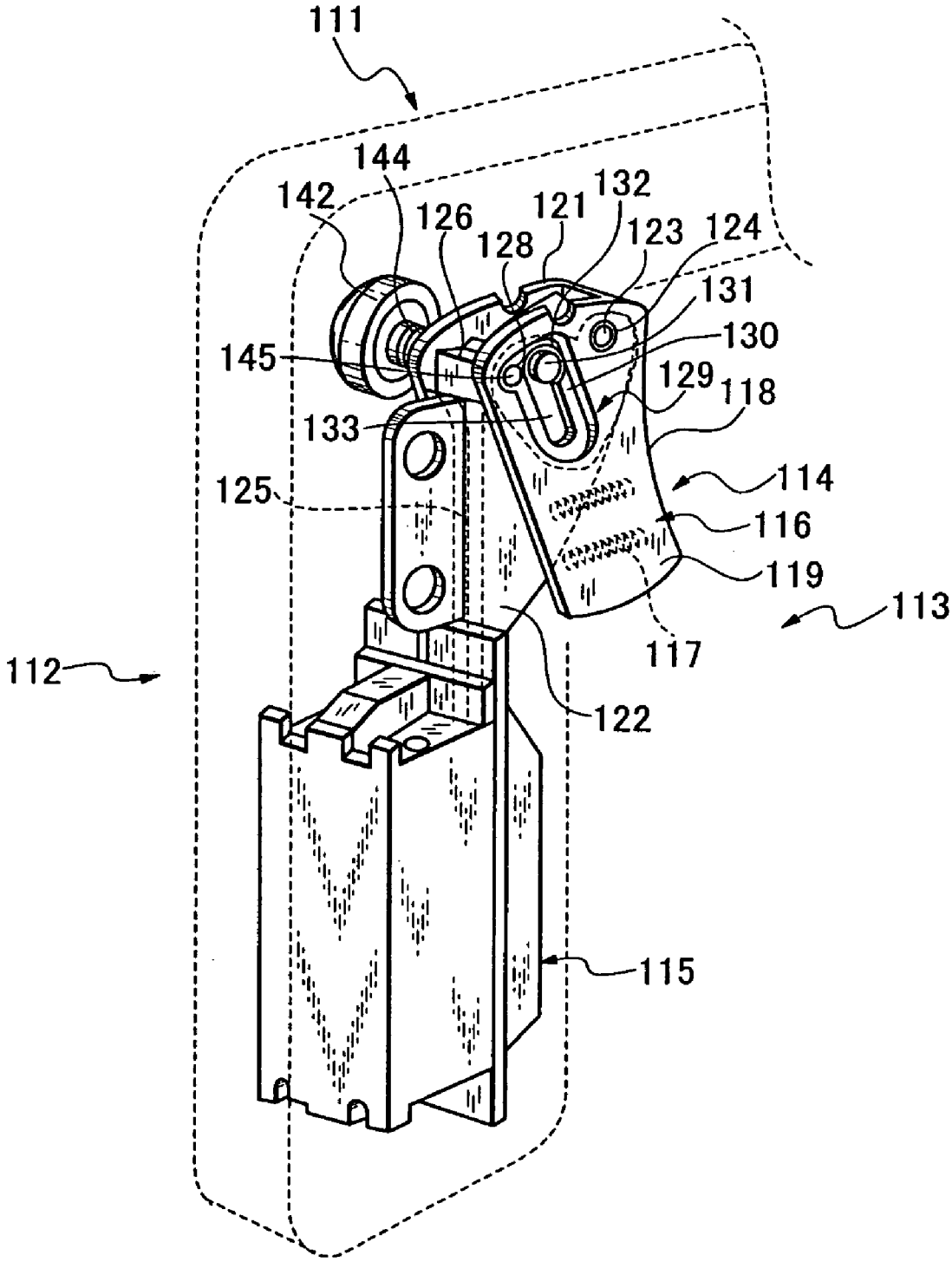
Fig. 5 PRIOR ART
FIG. 5 is a perspective view of a conventional trigger switch mounted to an electric power tool.
Figure 6:
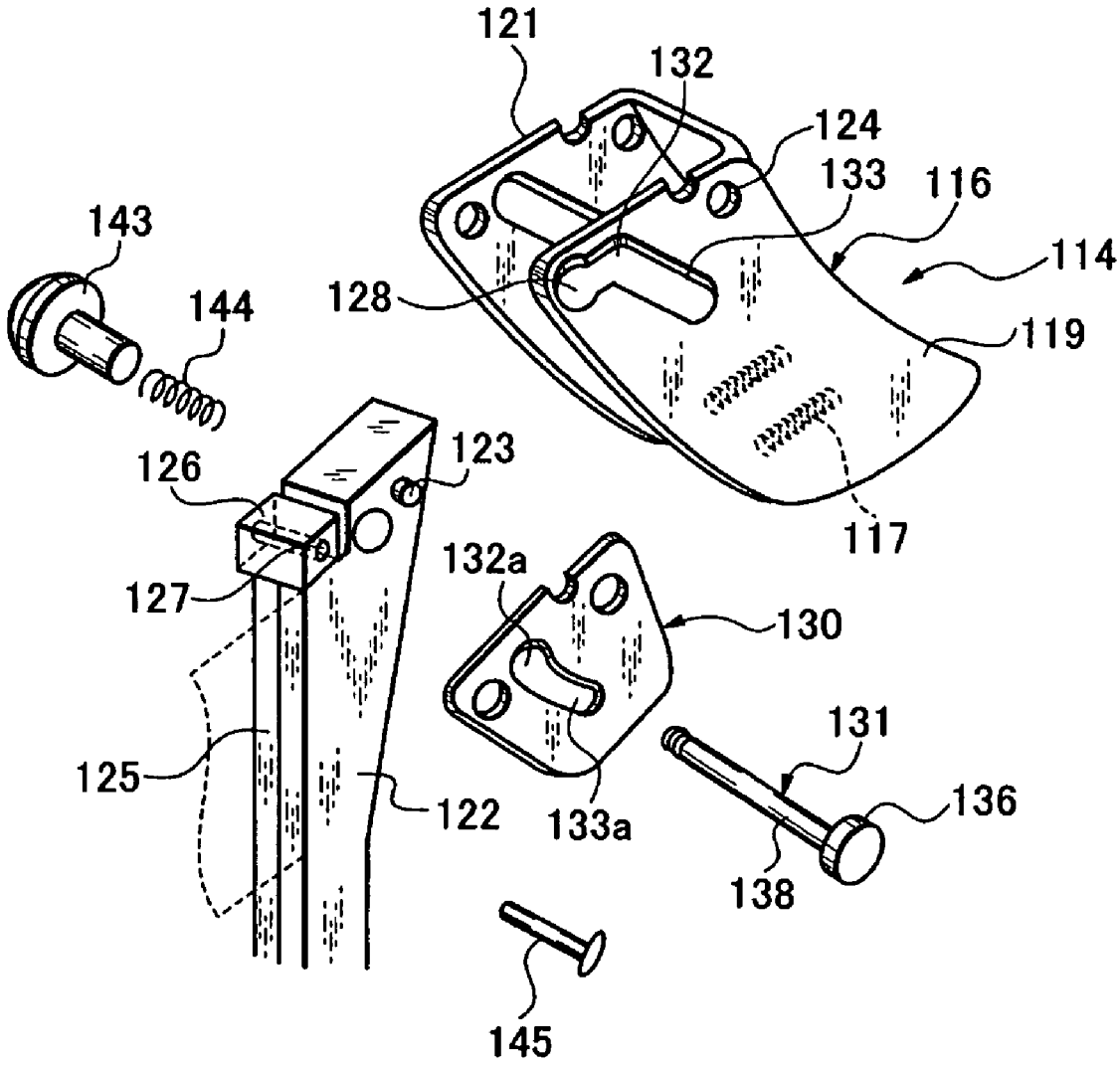
Fig. 6 PRIOR ART
FIG. 6 is an exploded perspective view of the trigger portion of the conventional trigger switch.
Figure 7:
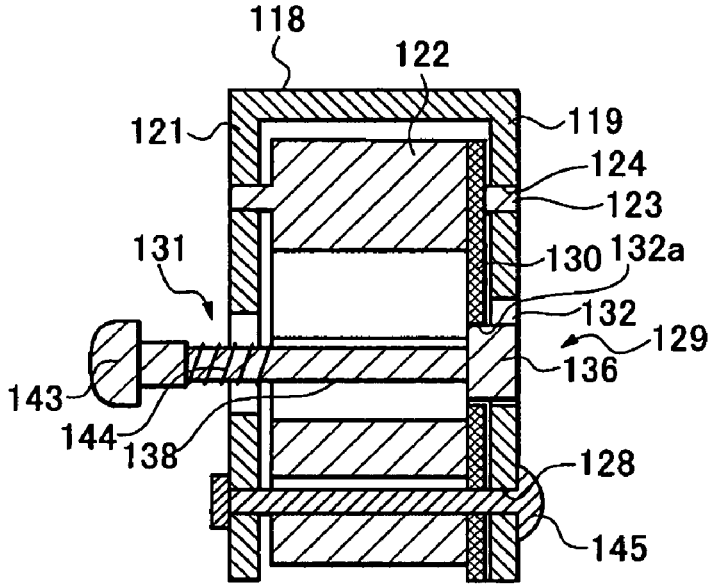
Fig. 7 PRIOR ART
FIG. 7 is a vertical cross section of the trigger portion of the conventional trigger switch in which the stopper button is not pushed.
Figure 8:
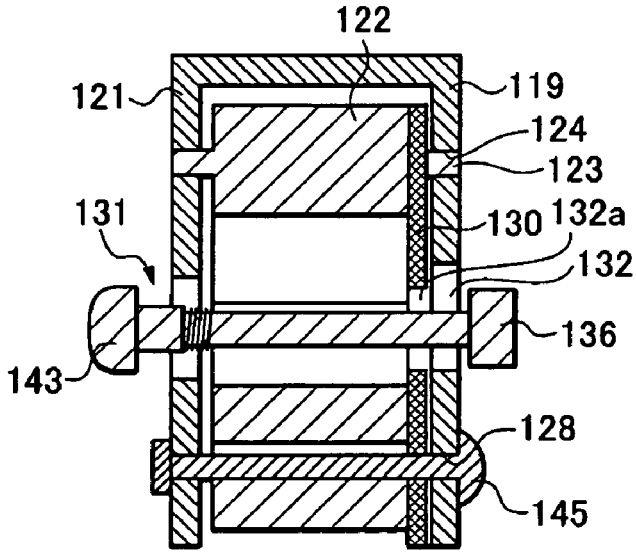
Fig. 8 PRIOR ART
FIG. 8 is a vertical cross section of the trigger portion of the conventional trigger switch in which the stopper button has been pushed.

When the trigger 16 is pulled in, the stopper button 45 is pushed as shown in FIG. 4. This disengages the first lock portion 37 of the stopper shaft 31 from the first stopper hole 32. Instead, the first guide portion 38 faces the first stopper hole 32 and, at the same time, the second lock portion 39 disengages from the second stopper hole 34. Instead, the second guide portion 41 faces the second stopper hole 34. Because the first guide portion 38 and second guide portion 41 are sufficiently smaller in diameter than the first stopper hole 32 and second stopper hole 34, if the trigger 16 is pulled, the first guide portion 38 and second guide portion 41 are guided along the first guide slot 33 and second guide slot 35 without abutting against the first stopper hole 32 or second stopper hole 34 according to the degree to which the trigger 16 has been pulled. When the trigger is pulled in to a given extent the switch inside the switch body is inverted and turned on.

When the trigger switch 16 is released, the return spring 17 incorporated in the trigger returns the trigger 16 to its original state. The switch inside the switch body is inverted and turned off. The first guide portion 38 and second guide portion 41 guided by the first guide slot 33 and second guide slot 35, respectively, are returned to their original positions while being guided by the first guide slot 33 and second guide slot 35, respectively. The first lock portion 37 and second lock portion 39 face the first stopper hole 32 and second stopper hole 34, respectively, and become at rest unless the stopper button 45 is pushed.

What is claimed is:

1. A trigger switch comprising:

a trigger having wall surfaces adjacent to each other on a base side, the wall surfaces being disposed opposite to each other with a given space therebetween;

a touch portion adapted to be touched by fingers, the touch portion being located on the base side;

pivotal holes formed in the wall surfaces and located above and closer to the touch portion;

a pivotal shaft inserted in the pivotal holes such that the shaft is interposed between the pivotal holes;

rotary shaft holes formed in the wall surfaces;

a rotary shaft for inverting a switch, the rotary shaft being located at a position remote from the pivotal shaft and from the touch portion, the rotary shaft being inserted in the rotary shaft holes such that the rotary shaft is interposed between the rotary shaft holes; and a stopper for stopping the trigger from being pulled in while being rotated about the pivotal shaft, the stopper being mounted between the pivotal shaft and the rotary shaft;

wherein the stopper including a first and second stopper holes formed in the wall surfaces, a stopper shaft engaged in the first and second stopper holes, and a stopper button mounted at an end of the stopper shaft;

the first and second stopper holes having a first and second guide slots communicating with the stopper holes and being narrower than diameters of the first and second stopper holes;

the stopper shaft having a first and second lock portions having smaller diameters than ones of the first and second stopper holes but larger than width of the first and second guide slots, and a first and second guide portions having smaller diameters than ones of the first and second guide slots to allow insertion of the guide portions therein;

whereby when the stopper button is pushed, the stopper shaft is moved to remove the first and second lock portions from the first and second stopper holes, and the first and second guide slots are moved into the first and second guide slots, thus releasing the trigger from the stopper.

2. The trigger switch according to claim 1, wherein the stopper shaft is provided with a return spring incorporated to return the trigger to its original state.

* * * * *